US006321626B1

(12) United States Patent
Liu

(10) Patent No.: US 6,321,626 B1
(45) **Date of Patent: *Nov. 27, 2001**

(54) MAGNETIC DRIVING TOOL HAVING A TELESCOPIC PIPE

(75) Inventor: Kuo Zhen Liu, Da Li (TW)

(73) Assignee: ICC Innovative Concepts Corporation, Torrington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/259,725

(22) Filed: Mar. 1, 1999

Related U.S. Application Data

(63) Continuation of application No. 08/957,968, filed on Oct. 21, 1997, now Pat. No. 5,878,637, which is a continuation-in-part of application No. 08/643,026, filed on May 2, 1996.

(51) Int. Cl.[7] ..... B25B 23/08
(52) U.S. Cl. ..... 81/451; 7/168; 294/65.5
(58) Field of Search ..... 7/138, 165; 81/125, 81/438; 294/65.5

(56) References Cited

U.S. PATENT DOCUMENTS 4,448,097 * 5/1984 Rocca .
5,487,576 * 1/1996 DuVivier .

FOREIGN PATENT DOCUMENTS

718990 * 6/1952 (GB) .

OTHER PUBLICATIONS

Handy Twins International Co., LTD, Invoice No. HT–96/0606(A) dated Jun. 6, 1996.
Handy Twins International Co., LTD Invoice No. 004675–IN dated Jun. 18, 1996.
Handy Twins International Co., LTD Invoice No. 0004674–IN dated Jun. 18, 1996.
Product Packaging for 8 in 1 Screwdriver and Telescoping Magnetic Pick–Up Tool by FineLine.(3 pages).
Photograph of Screwdriver Tool, Fineline (2 pages).
Advance Auto Parts Invoice No. 4674–IN Dated Jul. 10, 1996.
Advance Auto Parts Invoice No. 4761–IN Dated Aug. 2, 1996.
Advance Auto Parts Invoice No. 4762–IN Dated Aug. 5, 1996.
Advance Auto Parts Invoice No. 5269–IN Dated Sep. 23, 1996.

* cited by examiner

*Primary Examiner*—James G. Smith
(74) *Attorney, Agent, or Firm*—Handal & Morofsky

(57) ABSTRACT

A driving tool includes a barrel and a handle secured to one end of the barrel for rotating the barrel. The barrel includes an engaging opening formed in the other end for engaging with a tool bit and a fastener. A telescopic pipe is engaged in the bore of the barrel and has one end secured to the handle and has a magnetic member secured to the other end for allowing the magnetic member to be extended outward of the barrel to attract and to fetch the fasteners engaged in a deep hole of an object.

22 Claims, 3 Drawing Sheets

MAGNETIC DRIVING TOOL HAVING A TELESCOPIC PIPE

This application is a continuation application of my U.S. application Ser. No. 08/957,968, filed on Oct. 21, 1997 now U.S. Pat. No. 5,878,637, which is a continuation-in-part of U.S. patent application Ser. No. 08/643,026, filed on May 2, 1996 the disclosures of which are hereby incorporated herein by reference thereto.

BACKGROUND OF THE INVENTION

1. Field of the Invention

The present invention relates to a driving tool, and more particularly to a socket wrench having a telescopic pipe.

2. Description of the Prior Art

Typical driving tools, such as wrenches or screw drivers, comprise a driving stem having an engaging hole formed in one end for engaging with a tool bit or for engaging with a fastener and for driving the same. Two typical driving tools are disclosed in UK patent no. 718,990 to Ulfving, and in U.S. Pat. No. 4,448,097 to Rocca. The typical driving tools comprise a driving stem having either of two ends adapted to be engaged in an outer sleeve and adapted to be driven by the outer sleeve. The ends of the driving stem may be used for engaging with and for driving tool bits and/or fasteners. However, the driving tools may not be used for fetching the fasteners dropped in a deep hole such that an additional tool is required for fetching the fasteners. U.S. Pat. No. 5,487,576 discloses a tool having an extendible member. However, the tool also may not be used for fetching the fasteners dropped in a deep hole and may not be used as a driving tool.

The present invention has arisen to mitigate and/or obviate the afore-described disadvantages of the conventional magnetic socket wrenches.

SUMMARY OF THE INVENTION

The primary objective of the present invention is to provide a magnetic driving tool having a telescopic pipe for fetching the fasteners engaged in a deep hole.

In accordance with one aspect of the invention, there is provided a driving tool comprising a barrel including a bore and including a first end and including a second end having an engaging opening for engaging with a tool bit and a fastener, a handle secured to the first end of the barrel for rotating the barrel, a telescopic pipe engaged in the bore of the barrel and including a first end secured to the handle and including a second end adapted to be extended outward of the bore of the barrel, and a magnetic member secured to the second end of the telescopic pipe for allowing the magnetic member to be extended outward of the bore of the barrel. The barrel may be used for driving tool bits and/or fasteners and the telescopic pipe may be used for fetching the fasteners that are engaged in the deep hole of an object.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
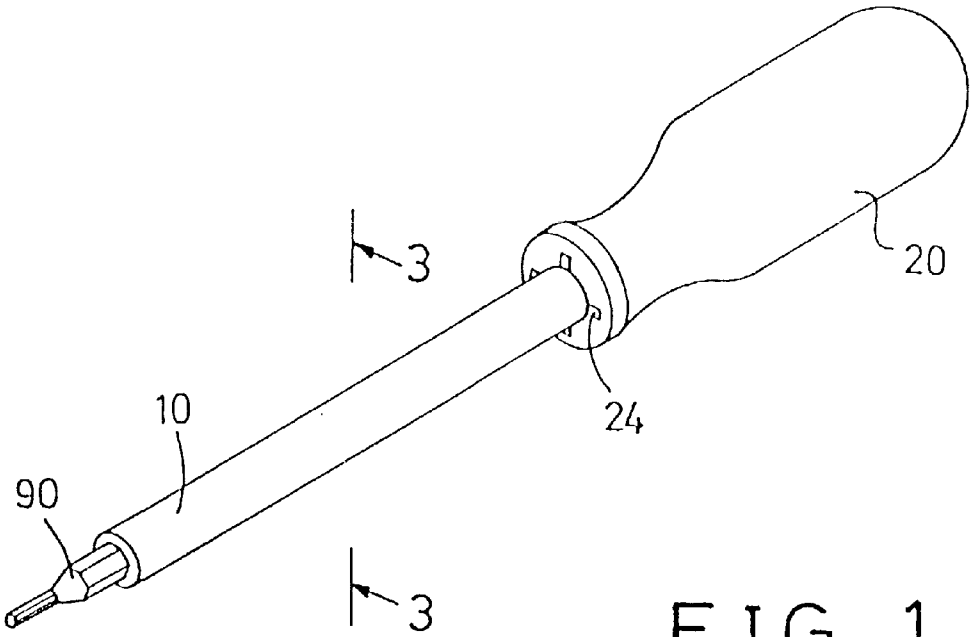
FIG. 1 is a perspective view of a driving tool in accordance with the present invention.
Figure 3:
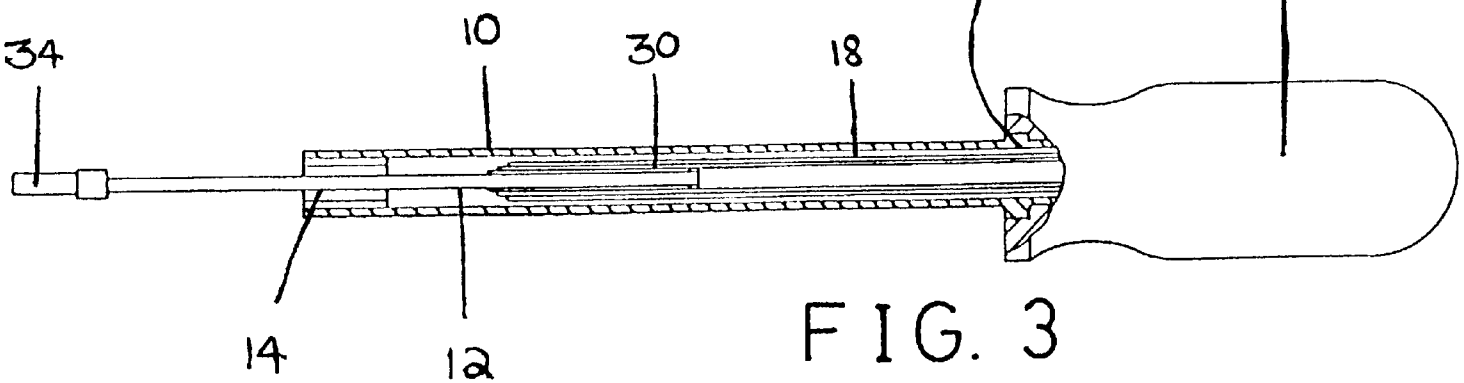
FIG. 3 is a partial cross sectional view taken along lines 3—3 of FIG. 1.
Figure 2:
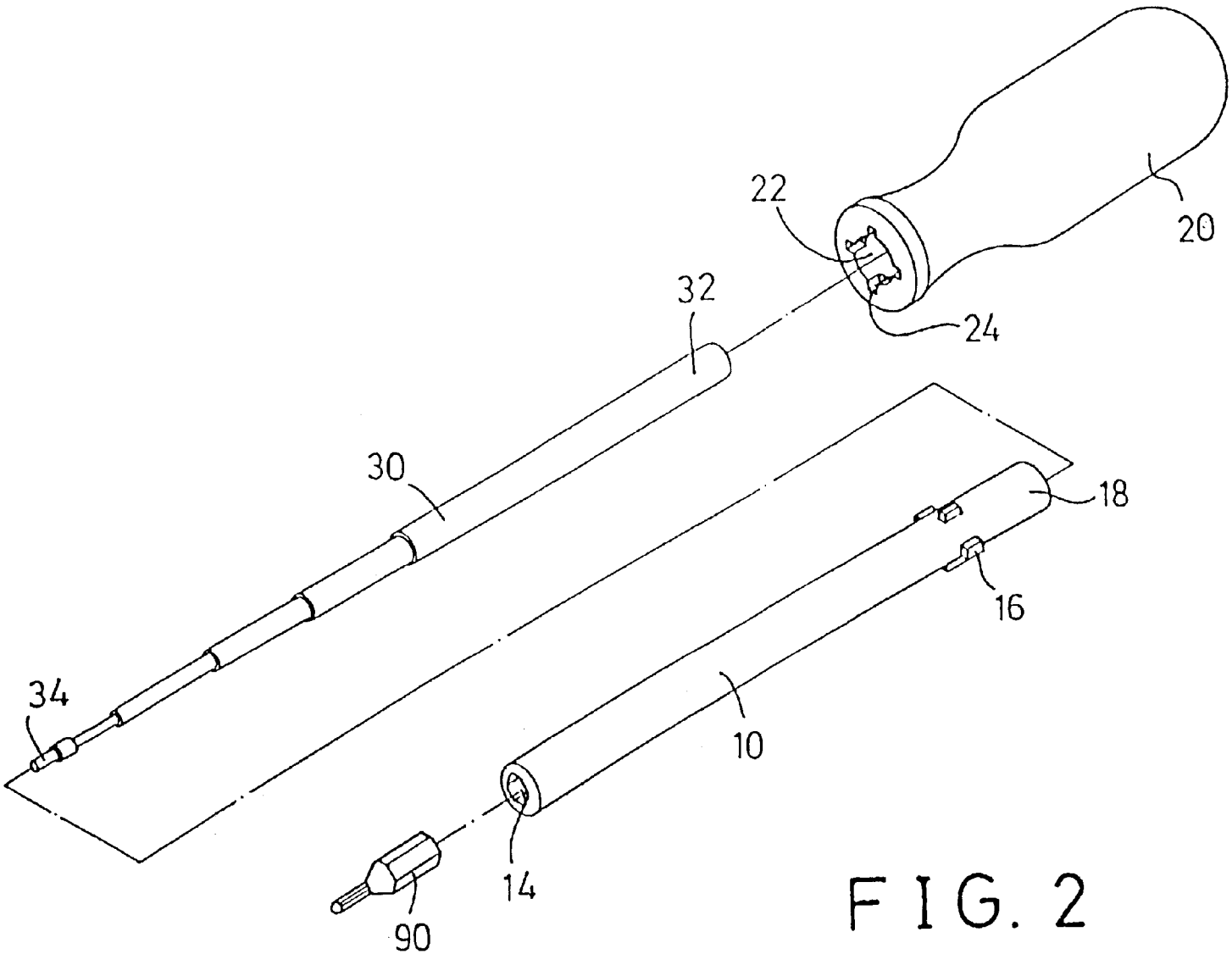
FIG. 2 is an exploded view of the driving tool.
Figure 4:
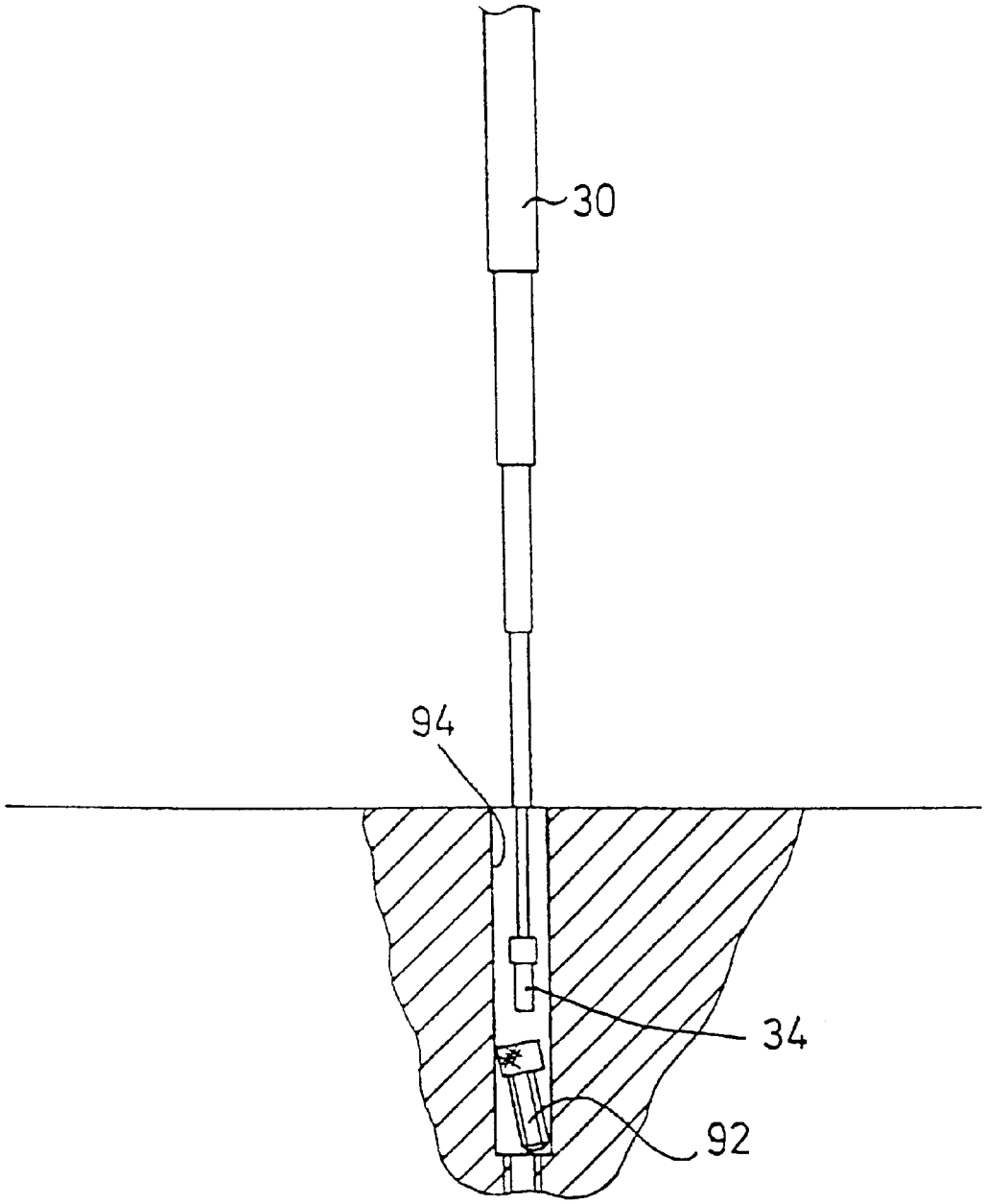
FIG. 4 is a schematic view illustrating the operation of the driving tool.

Referring to the drawings, and initially to FIGS. 1–3, a driving tool in accordance with the present invention comprises a barrel 10 including a bore 12 for slidably receiving a telescopic pipe 30 and including an engaging opening 14 formed in one end for engaging with and for driving a tool bit 90 or a fastener 92 (FIG. 4). The barrel 10 includes one or more keys 16 formed on the other end 18 for engaging with the grooves 24 of a handle 20 by such as a force-fitted engagement. The other end 18 of the barrel 10 is engaged in the hole 22 of the handle 20. Alternatively, the other end 18 of the barrel 10 may also be solidly secured in the hole 22 of the handle 20 by molding process, for example. The telescopic pipe 30 includes one end 32 secured in the handle 20 and includes a magnetic member 34 secured to the other end for allowing the magnetic member 34 to be extended outward of the barrel 10 and for allowing the magnetic member 34 to attract the fastener 92 that is engaged in a deep hole 94.

In operation, as shown in FIG. 4, the magnetic member 34 of the telescopic pipe 30 may be extended outward of the barrel 10 and may be engaged into the deep hole 94 of an object for easily attracting and fetching the fastener 92. When the telescopic pipe 30 is retracted into the bore 12 of the barrel 10, the engaging opening 14 of the barrel 10 may also be used for engaging with and for driving the tool bit 90 or the fastener 92 directly. The magnetic member 34 may be moved inward of the bore 12 of the barrel 10 by the tool bit 90 or the fastener 92, and may be moved and pulled outward of the barrel 10 by the tool bit 90 which may be engaged into the engaging opening 14 for allowing the tool bit 90 to be attracted by the magnetic member 34.

Typical driving tools may not be used for fetching the fasteners engaged in the deep hole and fail to disclose a driving tool having a telescopic pipe for allowing the magnetic member to be extended outward of the driving barrel. The driving tool in accordance with the present invention may be used for driving a tool bit or a fastener and may be used for easily fetching the fasteners engaged in a deep hole, such that the driving tool benefits the workers a lot.

Accordingly, the driving tool in accordance with the present invention includes a driving barrel for driving a tool bit or a fastener and includes a telescopic pipe for fetching the fasteners engaged in a deep hole.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool for applying a rotary torque, comprising:

(a) a handle;

(b) a shaft having a first end and a second end, said shaft being secured to said handle at said first end of said shaft;

(c) a socket defined in said second end of said shaft, said socket being configured and dimensioned to engage a tool bit;

(d) a bore defined in said shaft, said bore extending from said socket, and together with said socket defining a housing space;

(e) an extendable member capable of being extended and retracted to a plurality of different lengths and being secured in a position where said extendable member is, at least in part, in said housing space, said extendable member having a tip end and a base end, said extendable member being oriented with said tip end being extendable from a first point, within said housing space and closer to said socket than said base end, to a second point outside said housing space; and (f) a magnetic member secured to said tip end of said extendable member, said extendable member being configured an dimensioned at a retracted length where said magnetic member is magnetically coupled to a tool bit in said socket, whereby said magnetic member and said extendable member may be pulled outwardly of said housing space by a bit in said socket.

2. A tool for applying a rotary torque, as in claim 1, wherein, said extendable member is secured within said housing space.

3. A tool as in claim 2, wherein said handle is configured to be grasped by the hand of a user and rotated.

4. A tool as in claim 2, wherein said shaft is elongated in shape and said bore is elongated in shape.

5. A tool as in claim 2, wherein said said shaft is secured to said handle by an arrangement of mating keys and grooves.

6. A tool as in claim 2 wherein said extendable member is a telescopic member comprising a plurality of cylindrical members of different diameters.

7. A tool as in claim 2, wherein said extendable member is secured at its base end to said handle.

8. A tool as in claim 1, wherein said said shaft is secured to said handle by an arrangement of mating keys and grooves.

9. A tool as in claim 8, wherein said handle is configured to be grasped by the hand of a user and rotated, said shaft is elongated in shape and said bore is elongated in shape, and said extendable member is a telescopic member.

10. A handheld driving tool for rotatably driving fasteners with a tool bit, the tool comprising:

a) a rotatable hollow shaft;

b) a handle secured to one end of the shaft for holding the tool and rotating the hollow shaft;

c) an annular socket secured to the other end of the shaft and having a socket opening shaped to engage a tool bit for driving the fastener; and d) an extendable member accommodated in the hollow shaft, the extendable member having a magnetized end;

wherein the extendable member is extendable outwardly of the hollow shaft to dispose the magnetized end remotely from the hollow shaft and the magnetized end can pass through the socket opening as the extendable member is extended.

11. A tool according to claim 10 wherein the extendable member has an extended configuration and a retracted configuration and wherein in the retracted configuration the extendable member is contained wholly within the tool.

12. A tool according to claim 11 wherein the extendable member comprises multiple telescopic tubes slidable one within the other.

13. A tool according to claim 10 wherein the socket opening has a hexagonal shape.

14. A tool according to claim 10 wherein the extendable member has a retracted configuration and an extended configuration and can be moved from the retracted to the extended configuration by manual movement of a magnetic tool bit inserted into the socket opening, the tool bit being magnetically attracted to the magnetized end of the extendable member.

15. A tool according to claim 10 wherein the magnetized end is secured to the extendable member.

16. A tool according to claim 10 comprising a magnetic tool bit engaged in the annular socket for driving a fastener, wherein the magnetized end of the extendable member is adjacent the tool bit and wherein manual removal of the tool bit from the annular socket withdraws the extendable member through the annular socket.

17. An extensible magnetic screwdriver comprising:

a) a handle;

b) a hollow outer sleeve having an interior, being connected to the handle and having a forward opening with respect to the handle;

c) a screwdriver bit engageable with the forward opening;

d) an extensible inner pipe in the interior of the hollow outer sleeve; and e) a magnetic chuck disposed on a forward end of the extensible inner pipe;

wherein the extensible inner pipe is extensible to enable the magnetic chuck to reach into a deep hole.

18. A screwdriver according to claim 17 wherein the screwdriver bit is engaged with the forward opening and the magnetic chuck engages the rear of the screwdriver bit and is within the outer sleeve.

19. A screwdriver according to claim 17 wherein the forward opening is hexagonal shaped and the screwdriver bit is a hex bit.

20. A screwdriver according to claim 17 having the inner pipe extended and being located so that the magnetic chuck reaches the bolt in the deep hole.

21. A screwdriver according to claim 17 comprising a plurality of extensible inner pipes.

22. A screwdriver according to claim 21 wherein the screwdriver bit is engaged with the forward opening and the magnetic chuck engages the rear of the screwdriver bit and is within the outer sleeve.

* * * * *